United States Patent [19]

Boutcher, Jr.

[11] Patent Number: 4,790,173

[45] Date of Patent: Dec. 13, 1988

[54] SHUT HEIGHT ADJUSTMENT MEANS IN PRESSING APPARATUS

[75] Inventor: Andrew G. Boutcher, Jr., Harrisburg, Pa.

[73] Assignee: AMP Incorporated, Harrisburg, Pa.

[21] Appl. No.: 55,671

[22] Filed: May 29, 1987

[51] Int. Cl.[4] ..... B21J 13/00

[52] U.S. Cl. ..... 72/446; 72/32; 72/413; 72/481; 100/257; 29/753; 83/530; 83/527

[58] Field of Search ..... 72/32, 36, 400, 399, 72/481, 482, 441, 446, 473, 472, 455, 413, 481; 100/257; 29/34 R, 753; 83/527, 530

[56] References Cited

U.S. PATENT DOCUMENTS

| | | | |
|---|---|---|---|
| 2,713,279 | 6/1955 | Harris | 72/36 |
| 3,115,922 | 12/1963 | Straubel | 153/1 |
| 3,184,950 | 5/1965 | Sitz . | |
| 3,687,069 | 8/1972 | Helrigel et al. | 72/446 |
| 3,911,717 | 10/1975 | Yoda . | |
| 3,948,077 | 4/1976 | Boths | 72/441 |
| 4,676,090 | 6/1987 | Nishimura | 72/446 |
| 4,677,908 | 7/1987 | Imanishi et al. | 100/267 |

*Primary Examiner*—David Jones

*Attorney, Agent, or Firm*—Thomas G. Terrell; James M. Trygg

[57] ABSTRACT

A device for adjusting the shut height of a press includes a rotatable dial (16) interposed between a ram mounting block (6) fixed to a press ram (2), and a tooling ram (14). The dial (16) is keyed to a screw bushing (12) which is rotatable in a screw threaded bore in the block (6) for vertical movement relative to the block (6). Facing surfaces (46 and 48) of the block (6) and the dial (16) are formed with opposed helical ramps (54 and 56, and 58 and 60). The angular position of the dial (16) is adjustable to cause the ramps (54 and 56, and 58 and 60) to cooperate to alter the distance between ramps (2) and 14) to adjust the shut height of the press.

11 Claims, 2 Drawing Sheets

SHUT HEIGHT ADJUSTMENT MEANS IN PRESSING APPARATUS

This invention relates to shut height adjustment means for determining the spacing between first and second rams in pressing apparatus, and relates especially to such means in presses for crimping electrical terminals to wires.

Such crimping presses usually comprise a tooling ram carrying a crimping die for cooperation with an anvil to crimp a ferrule of an electrical terminal to a wire, the tooling ram being driven by a press ram through a working stroke to crimp the terminal to the wire and through a return stroke. In a crimping operation, the shut height of the tooling, that is to say the distance between the crimping die and the anvil at the end of said working stroke must be precisely adjusted if a satisfactory cold forged connection is to be made between the ferrule and the wire. This is disclosed in U.S. Pat. No. 3,115,922 and U.S. Pat. No. 3,184,950, which are incorporated herein by reference, a shut height adjusting means comprising a dial having a plurality of projections of varying heights thereon which is interposed between the two rams of a crimping press, and which can be rotated to determine the distance between the two rams and thus the shut, or crimp, height of the tooling. However, the shut height can only be adjusted stepwise, by interposing selected projections between the rams.

The present invention is intended to provide for the continuous adjustment of said shut so that it can be finely adjusted for use with any terminal within a given size range, rather than only with terminals of selected sizes within that range.

According to the invention, in pressing apparatus having a first ram and a second ram connected thereto in spaced relationship therewith to drive the first ram along a predetermined path, adjusting means for altering the spacing between said rams, comprises a ram mounting block fixed to the second ram and being located between said rams, said block having a screw threaded bore having a longitudinal axis extending lengthwise of said path; a screw device in said bore meshing with the threads thereof and being rotatable therein about said axis, for movement relative to said block, lengthwise of said axis, said screw device being connected to said rams with axial play; a dial keyed to said screw device, for rotation about said axis to move the first and second rams relatively towards and away from each other; and ramp means acting between said block and said dial, for determining the spacing between said rams in accordance with the angular position of said dial about said axis, the second ram being in force transmitting relationship with the first ram by way of said block and said dial as said first ram is driven by said second ram.

The ramp means may comprise a pair of helical ramps on each of the blocks and the dial, the ramps extending about said axis and the helical pitch of each ramp being the same as that of the screw threads of the block and the screw device, the ramps being of equal angular extent and being arranged in opposed relationship. The screw device preferably comprises an externally screw threaded bushing which is rotatable about a hub, connected to the rams with clearance.

The dial may be marked with a scale but is preferably surrounded by a scale bearing sleeve which is angularly adjustable about said axis.

The shut height adjusting means may be incorporated between a press ram of a power driven press and a terminal applicator which is detachably mounted to the press, or the shut height adjusting means may be incorporated in the applicator itself.

Said angular position of the dial may be set manually and the scale bearing sleeve adjusted angularly to account for press or tooling drift (settling in) which may occur during continuous operation.

Should the press be included in a fully automatic lead making, or harness making, machine, the dial may be angularly adjusted under the control of an electronic control circuit of the machine.

For a better understanding of the invention, reference will now be made by way of example to the accompanying drawings, in which.

Figure 2:
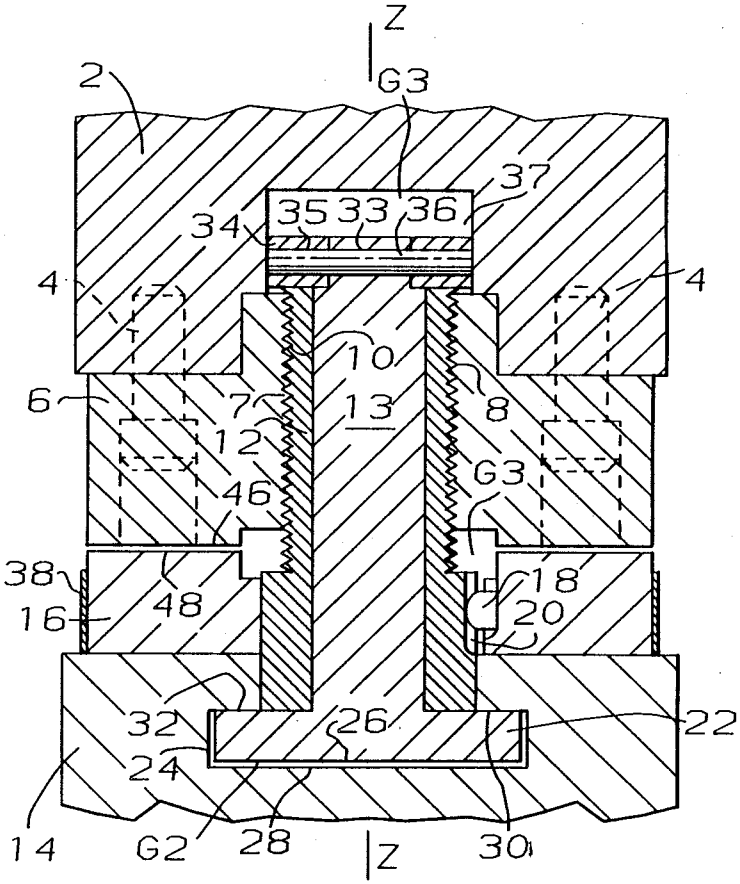
FIG. 2 is a similar view to that of FIG. 1 but showing the adjusting means in a minimum shut height position.
Figure 1:
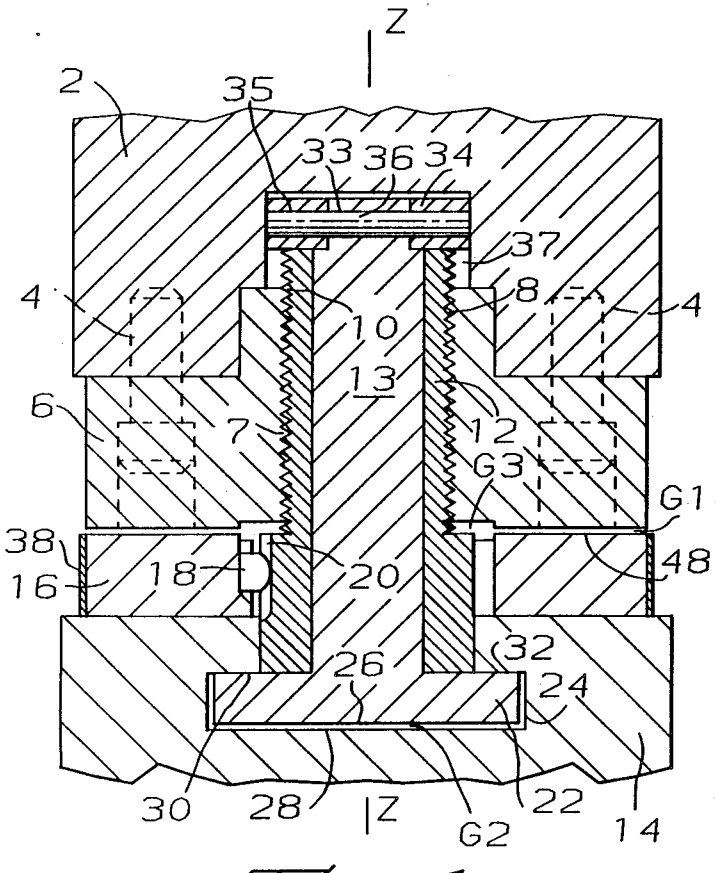
FIG. 1 is an axial sectional view of shut height adjusting means installed in a pressing apparatus, the adjusting means being in a maximum shut height position.

As shown in FIGS. 1 and 2, a press ram 2, which is arranged to be driven in vertical reciprocating motion, through working and return strokes, by means of a driving mechanism (not shown), for example, according to U.S. Pat. No. 3,184,950, has fixed thereto, by means of bolts 4, a circular cross section, press ram mounting block 6 formed with an internal, screw threaded, axial bore 7 having screw thread 8. The thread 8 meshes with external screw threads 10 of a screw threaded bushing 12 which is rotatable in the bore 7 about the vertical axis Z—Z of a central hub 13 in the bushing 12, for adjustment lengthwise of the vertical path of movement of the ram 2. The lower end of hub 13 is connected with play to a tooling ram 14 driven by the ram 2 and carrying tooling (not shown) which may be an electrical terminal crimping die for cooperation with an anvil (not shown), according to the teaching for example of U.S. Pat. No. 3,184,950.

There is interposed between the block 6 and the ram 14, a shut height adjusting annular dial 16 having a keying nose 18 projecting radially inwardly of the dial 16 and which slidably engages in a vertical keying slot 20 in the bushing 12. At its lower end, as seen in FIGS. 1 and 2, the hub 13 has an annular flange 22 which is received in an undercut blind bore 24 in the ram 14, the lower face 26 of the flange 22 being spaced from the base 28 of the bore 24 with clearance G2. The upper face 30 of the flange 22 engages the upper face 32 of the undercut in the bore 24. The upper end of the hub 13 is surrounded by a bearing ring 34 secured to the hub 13 by means of a pin 36 extending through aligned transverse bores 33 and 35, respectively, in the hub 13 and the ring 34. The ring 34 is slidably received in a circular cross-section bore 37 in the ram 2.

Figure 3:
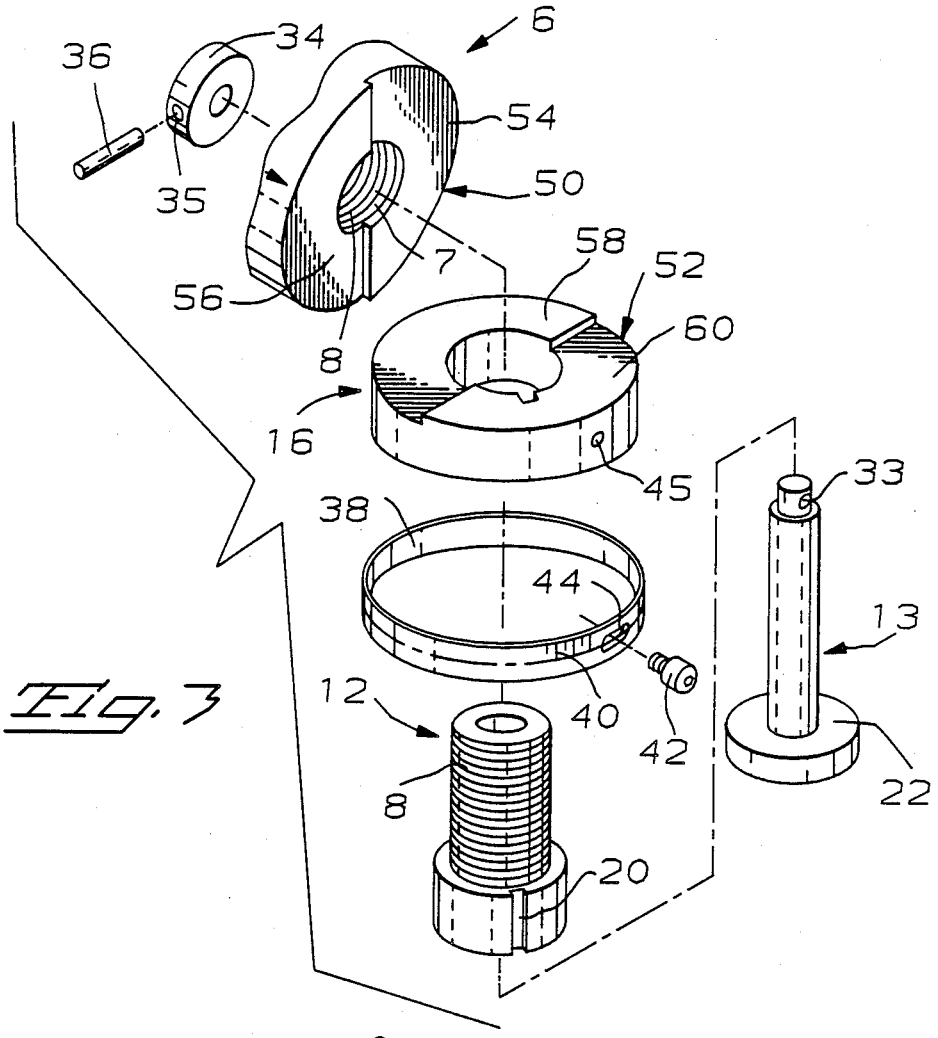
FIG. 3 is an isometric exploded view of the shut height adjusting means.
Figure 4:
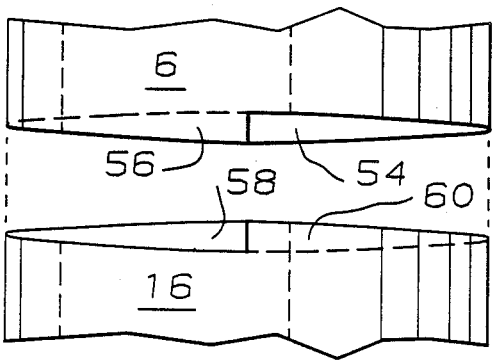
FIG. 4 is an enlarged, fragmentary side view illustrating details of the shut height adjusting means.

The dial 16 is surrounded by a scale sleeve 38 marked with a scale 40 extending thereabout. The sleeve 38 is secured to the dial 16 by means of a screw 42 (FIG. 3) passed through a peripherally extending slot 44 in the sleeve 38 and into a tapped opening 45 in the dial 16, so that the angular position of the sleeve 38 is adjustable about the axis Z—Z with respect to the dial 16.

The adjacent faces 46 and 48, respectively, of the block 6 and of the dial 16, are formed with cooperating adjustment ramp means generally referenced 50 and 52, respectively. The ramp means 50 comprises a pair of helical semicircular ramps 54 and 56, and the ramp means 52 comprising a pair of helical semicircular ramps 58 and 60. The ramps of each pair extend about the axis Z—Z in opposed relationship, Each ramp of each pair being in rotational symmetry in respect to the other ramp of the pair and the helical pitch of each ramp, being the same as that of the screw threads 8 and 10.

The ramp means 50 and 52 cooperate with one another in such a way that as the dial 38 is rotated, in relation to a bench mark (not shown) on the block 6 or the ram 14, the bushing 12 and thus the hub 13 are moved, relative to the ram 2, along the axis Z—Z, between the positions in which the bushing 12 and the hub 13 are shown in FIGS. 1 and 2, thereby to determine the spacing between the rams 2 and 14 and thus the shut height of the tooling, in accordance with the angular position of the dial 16 about the axis Z—Z.

As the dial 16 is turned in a clockwise (as seen in FIGS. 1 and 2) sense, from the position of FIG. 1 (maximum shut height) to that of FIG. 2 (minimum shut height), the effective combined height of the block 6 and the dial 16 is increased, so that the distance between the rams 2 and 14 is also increased. However, the minimum clearance G1 between the block 6 and the dial 16, which may be of 0.004 inches, remains the same in all angular positions of the dial 16. The clearance G2 between the faces 26 and 28, which may be of 0.006 inches and which in any event must always exceed the clearance G1, also remains the same in all angular positions of the dial 16. The difference between the maximum clearance G3 between the block 6 and the dial 16 in the FIG. 1 position of the bushing 12 and hub 13, and the maximum clearance G4 between the block 6 and the dial 16 in the FIG. 2 position of the bushing 12 and hub 13, is commensurate with the extent to which the said shut height can be adjusted by means of the dial 16.

As the ram 2 is driven through its working stroke, the clearance G1 is eliminated, but since the height of the clearance G2 always exceeds that of the clearance G1, the ram 2 is in force transmitting relationship with the ram 14 by way of the block 6 and the dial 16.

The clearance G1 could, for example, be of between 0.002 and 0.006 inches, but is constant as mentioned above, and must in any event be smaller than the clearance G2.

I claim:

1. In pressing apparatus having a first ram, and a second ram connected thereto in spaced relationship therewith, to drive the first ram along a predetermined path, adjusting means for coupling together and altering the effective spacing between said rams, said adjusting means comprising:

a ram mounting block fixed to the second ram, and being located between said rams, said block having a screw threaded bore having a longitudinal axis extending lengthwise of said path;

a screw device in said bore meshing with the threads thereof and being rotatable therein about said axis, for movement relative to said block, lengthwise of said axis, said screw device being connected to said first ram with axial play;

an adjusting dial keyed to said screw device, for rotation about said axis to move the first and second rams relatively towards and away from each other; and ramp means acting between said block and said dial, for determining the spacing between said rams in accordance with the angular position of said dial about said axis, said second ram being in force transmitting relationship with said first ram by way of said block and said dial as said first ram is driven by said second ram.

2. Adjusting means as claimed in claim 1, wherein said ramp means comprises cooperating ramps on said block and said dial.

3. Adjusting means as claimed in claim 2, wherein facing surfaces of said block and said dail are each formed with two opposed helical semicircular ramps extending about said axis in rotational symmetry.

4. Adjusting means as claimed in claim 3, wherein the pitch of each ramp is the same as that of the threads of said screw device and said block.

5. Adjusting means as claimed in claim 1, wherein the minimum clearance between said screw device and the first ram, exceeds the minimum clearance between said block and said dial prior to the first ram being driven by the second ram.

6. Adjusting means as claimed in claim 1, wherein said screw device comprises an externally screw threaded bushing which is rotatable about a hub therein, the hub having at one end, a flange received in an undercut blind bore in the first ram and having a surface facing the base of said bore and being spaced therefrom by a distance exceeding the minimum clearance between said block and said dial, prior to the second ram being driven by the first ram.

7. Adjusting means as claimed in claim 6, wherein the other end of said hub is received in a bore in the second ram and is surrounded by a bearing ring which is slidable in said bore lengthwise of said axis, at least by a distance exceeding the maximum clearance between said block and said dial.

8. Adjusting means as claimed in claim 1, wherein said dial has a scale bearing sleeve extending thereabout and being angularly adjustable about said axis with respect to said dial.

9. In a pressing apparatus comprising a tooling ram, and a press ram connected thereto in spaced relationship therewith to drive the tooling ram through a working stroke along a predetermined path in cooperation with an anvil, shut height adjusting means for coupling together and altering the spacing between said rams, said adjusting means comprising:

a ram mounting block fixed to the press ram and being located between the press ram and the tooling ram, and having a screw threaded bore having a longitudinal axis extending lengthwise of said path;

an externally screw threaded bushing meshing with said threads in said bore and being rotatable relative to said block about a hub, for movement lengthwise of said axis, the hub being connected to each of said rams;

an annular dial keyed to said bushing, for rotation about said axis, to move said rams relatively towards and away from one another; and a pair of helical ramps formed on each of facing surfaces of said block and said dial, the ramps of each pair extending about said axis and being arranged in opposed relationship and in rotational symmetry, to act between the block and the dial to determine the effective spacing between said rams in accordance with the angular position of said dial about said axis, the minimum clearance between the ramps of the block and those of the dial being less than the clearance between said hub and said tooling ram.

10. Adjusting means as claimed in claim 9, wherein the other end of said hub is slidable in a bore in the press ram, lengthwise of said axis, to an extent exceeding the difference between the minimum and the maximum clearance between the block and the dial.

11. Adjusting means as claimed in claim 10, wherein the dial is keyed to the bushing by means of a nose on the dial projecting radially inwardly thereof and slidably engaging in a groove in the bushing, the groove being elongate in the direction of said axis.

* * * * *